US011679486B2

(12) United States Patent
Lin et al.

(10) Patent No.: US 11,679,486 B2
(45) Date of Patent: Jun. 20, 2023

(54) PNEUMATIC TOOL AND A PNEUMATIC SEALING DEVICE THEREOF

(71) Applicant: BASSO INDUSTRY CORP., Taichung (TW)

(72) Inventors: Da-Jay Lin, Taichung (TW); San-Yih Su, Taichung (TW)

(73) Assignee: Basso Industry Corp., Taichung (TW)

( * ) Notice: Subject to any disclaimer, the term of this patent is extended or adjusted under 35 U.S.C. 154(b) by 732 days.

(21) Appl. No.: 16/546,762

(22) Filed: Aug. 21, 2019

(65) Prior Publication Data

US 2020/0070331 A1 Mar. 5, 2020

(30) Foreign Application Priority Data

Aug. 28, 2018 (TW) ..... 107129887

(51) Int. Cl.
*B25F 5/00* (2006.01)
*B25F 5/02* (2006.01)

(52) U.S. Cl.
CPC ..... *B25F 5/02* (2013.01)

(58) Field of Classification Search
CPC ..... B25F 5/00; B25F 5/02
See application file for complete search history.

(56) References Cited

U.S. PATENT DOCUMENTS 5,346,024 A * 9/1994 Geiger ..... B25F 5/001 173/221
6,250,399 B1 * 6/2001 Giardino ..... F01C 21/18 173/221
6,796,386 B2 * 9/2004 Izumisawa ..... B25F 5/00 173/93.5
7,404,450 B2 * 7/2008 Izumisawa ..... B25F 5/00 173/104
7,461,703 B2 * 12/2008 Cheng ..... B25F 5/00 173/168
7,802,633 B2 * 9/2010 Kobayashi ..... B25F 5/00 173/218
2003/0230423 A1 * 12/2003 Izumisawa ..... B25B 23/145 173/107
2012/0261154 A1 * 10/2012 Chen ..... B25F 5/00 173/221

FOREIGN PATENT DOCUMENTS

CN 101607392 A 12/2009
CN 106393001 A 2/2017

OTHER PUBLICATIONS

Search Report appended to an Office Action, which was issued to Taiwanese counterpart Application No. 107129887 by the TIPO dated Sep. 3, 2021 with an English translation thereof.

* cited by examiner

*Primary Examiner* — Eyamindae C Jallow
(74) *Attorney, Agent, or Firm* — Burris Law, PLLC

(57) ABSTRACT

A pneumatic tool includes a casing, a cylinder unit, a valve knob and a pneumatic sealing device. The casing has a main portion that has an inner surface defining a receiving space therein, and an outer surface opposite to the inner surface. The cylinder unit is mounted in the receiving space. The valve knob is disposed in the receiving space and is rotatably connected to the cylinder unit. The pneumatic sealing device includes a ring member that is ring-shaped and rigid, that surrounds and is connected to the valve knob, and that is clamped between the inner surface of the casing and the cylinder unit for keeping a distance between the casing and the cylinder unit constant.

15 Claims, 6 Drawing Sheets

PNEUMATIC TOOL AND A PNEUMATIC SEALING DEVICE THEREOF

CROSS-REFERENCE TO RELATED APPLICATION

This application claims priority of Taiwanese Patent Application No. 107129887, filed on Aug. 28, 2018.

FIELD

The disclosure relates to a pneumatic tool, and more particularly to a pneumatic tool and a pneumatic sealing device thereof.

BACKGROUND

Referring to FIG. 1, a conventional pneumatic tool 1 includes a casing 11, a cylinder unit 12, a valve knob 13 and a ring seal 14.

The casing 11 includes a first casing member 111, a second casing member 112 and a plurality of fastening members 113. The fastening members 113 extend through the first casing member 111 and into the second casing member 112 for fastening the first and second casing members 111, 112 together. The cylinder unit 12 is mounted in the casing 11. The valve knob 13 is rotatably mounted in the casing 11. The ring seal 14 is clamped between the valve knob 13 and the first casing member 111 of the casing 11 to form an airtight sealing. The first casing member 111 has an opening 114 that allows the valve knob 13 to be exposed therefrom. A user may rotate the valve knob 13 to regulate an amount of air that circulates in the cylinder unit 12, thereby controlling a power output generated by the cylinder unit 12.

In order to reduce an overall weight of the conventional pneumatic tool 1, the casing 11 is made of a light-weighted plastic material. As a result, an end portion of the first casing member 111 near the opening 114, which is directly affected by stress transmitted from the valve knob 13, is susceptible to plastic deformation. Such plastic deformation often causes the valve knob 13 to fail at remaining in concentric alignment with the cylinder unit 12 and, in turn, obstructs the rotation of the valve knob 13.

The end portion of the first casing member 111 may be designed to be thicker to avoid the plastic deformation of the casing 11, but such design has limited effect on increasing the structural strength and easily increases the overall weight of the pneumatic tool, contradicting the original objective.

Moreover, to ensure proper formation of the airtight sealing at the opening 114, the first and second casing members 111, 112 of the casing 11 need to be fastened tightly together. However, the manipulation of the fastening members 113 may also result in deformation of the end portion of the first casing member 111 to thereby obstruct the rotation of valve knob 13.

SUMMARY

Therefore, the object of the disclosure is to provide a pneumatic tool and a pneumatic sealing device thereof that can alleviate at least one of the drawbacks of the prior art.

According to an aspect of the disclosure, a pneumatic tool includes a casing, a cylinder unit, a valve knob and a pneumatic sealing device.

The casing is made of a plastic material, and has a main portion and a handle portion. The main portion has an inner surface defining a receiving space therein, an outer surface opposite to the inner surface, and an opening extending through the inner and outer surfaces and in spatial communication with the receiving space. The handle portion is connected to the main portion and is transverse to the main portion. The cylinder unit is mounted in the receiving space of the casing and is adapted to be driven by air to generate power. The valve knob is disposed in the receiving space of the casing and between the opening and the cylinder unit, is rotatably connected to the cylinder unit, and is adapted for regulating amount of the air circulating in the cylinder unit.

The pneumatic sealing device includes a ring member. The ring member is ring-shaped and rigid, is disposed in the receiving space, surrounds and is connected to the valve knob, and is clamped between the inner surface of the casing and the cylinder unit such that a distance between the casing and the cylinder unit is maintained to be constant.

According to another aspect of the disclosure, a pneumatic sealing device is adapted for use in a pneumatic tool. The pneumatic tool includes a casing that is made of a plastic material, a cylinder unit that is mounted in the casing, and a valve knob that is disposed in the casing, that is rotatably connected to the cylinder unit and that is adapted for regulating amount of air circulating in the cylinder unit.

The pneumatic sealing device includes a ring member that includes a first portion and a second portion. The first portion is adapted for surrounding the valve knob, and has a first abutting surface adapted for abutting against an inner surface of the casing, and a second abutting surface opposite to the first abutting surface and adapted for abutting against the cylinder unit such that a distance between the casing and the cylinder unit is maintained to be constant. The second portion surrounds the part of the cylinder unit and is adapted to be disposed between the casing and the cylinder unit.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
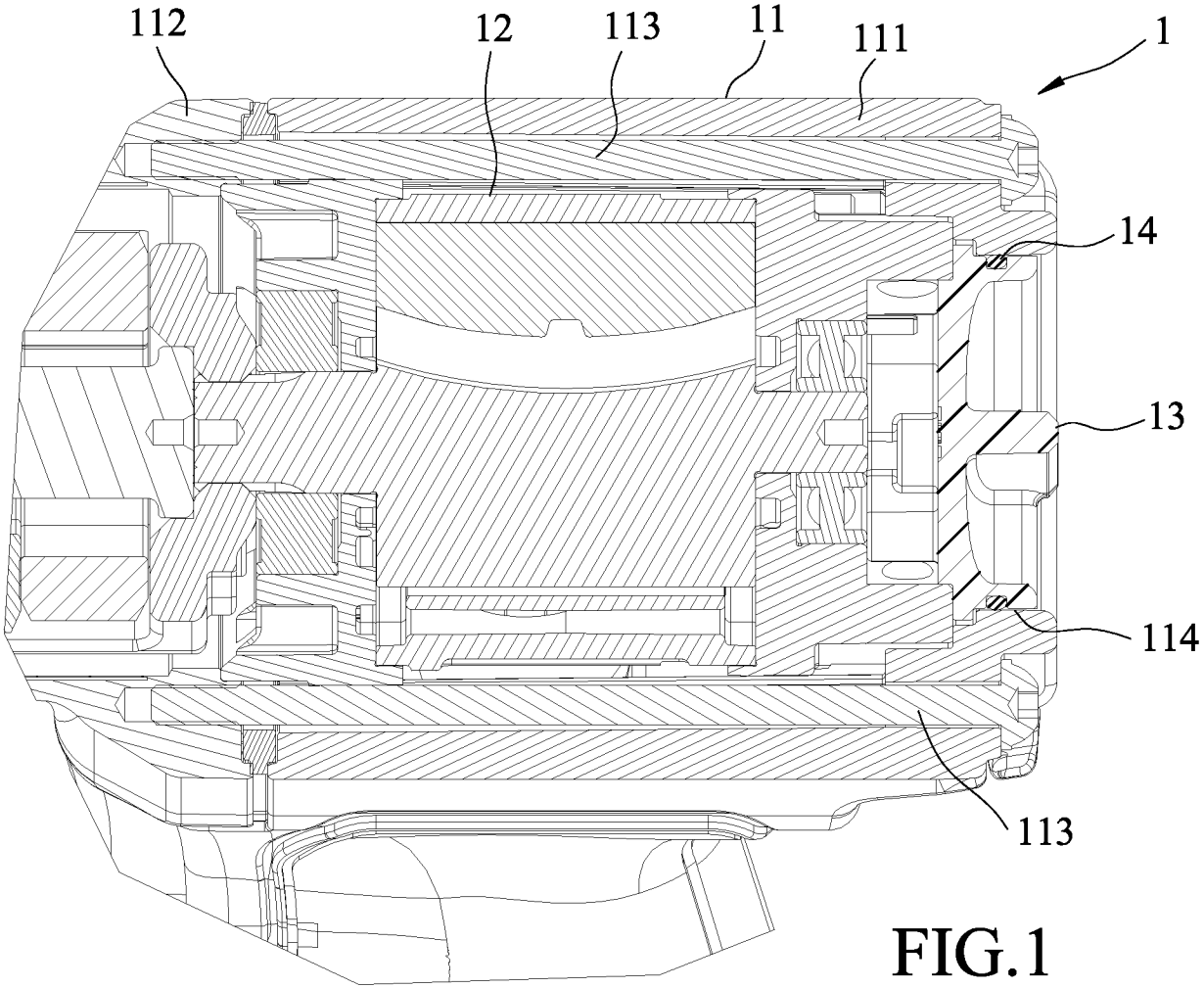
FIG.1 PRIOR ART
FIG. 1 is a fragmentary sectional view of a conventional pneumatic tool.
Figure 2:
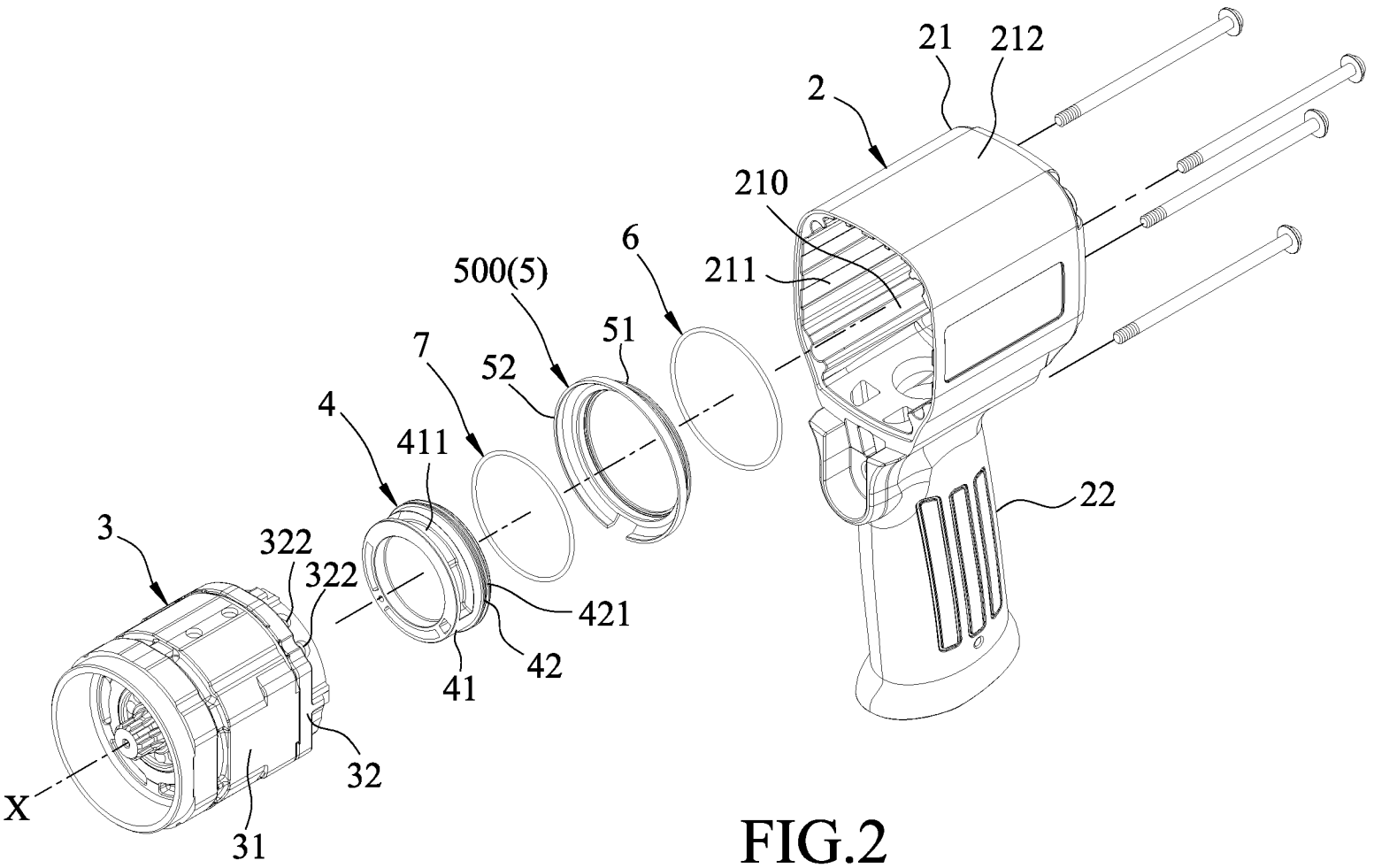
FIG. 2 is an exploded perspective view of a first embodiment of a pneumatic tool according to the disclosure.
Figure 3:
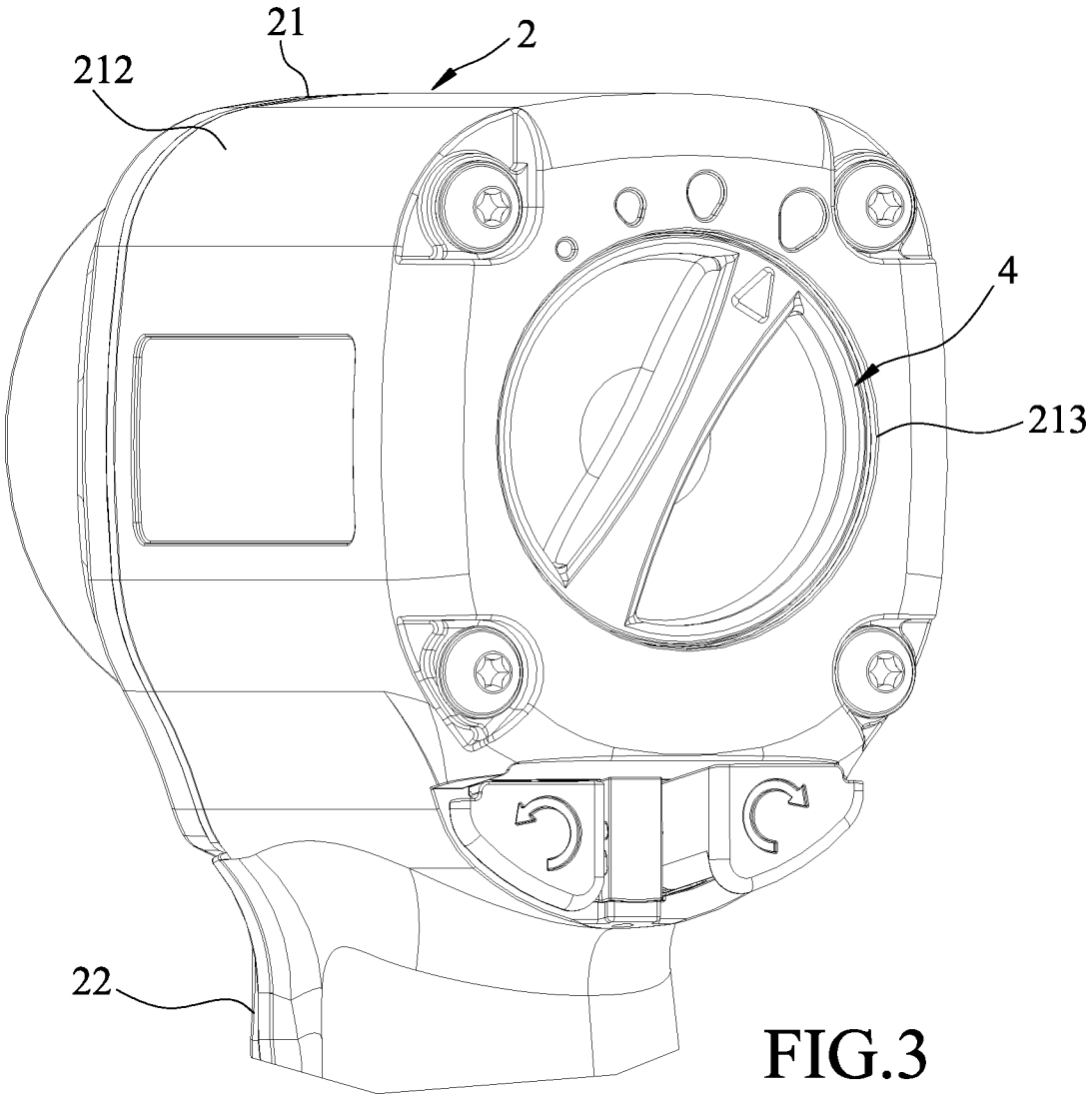
FIG. 3 is a fragmentary perspective view of the first embodiment.
Figure 4:
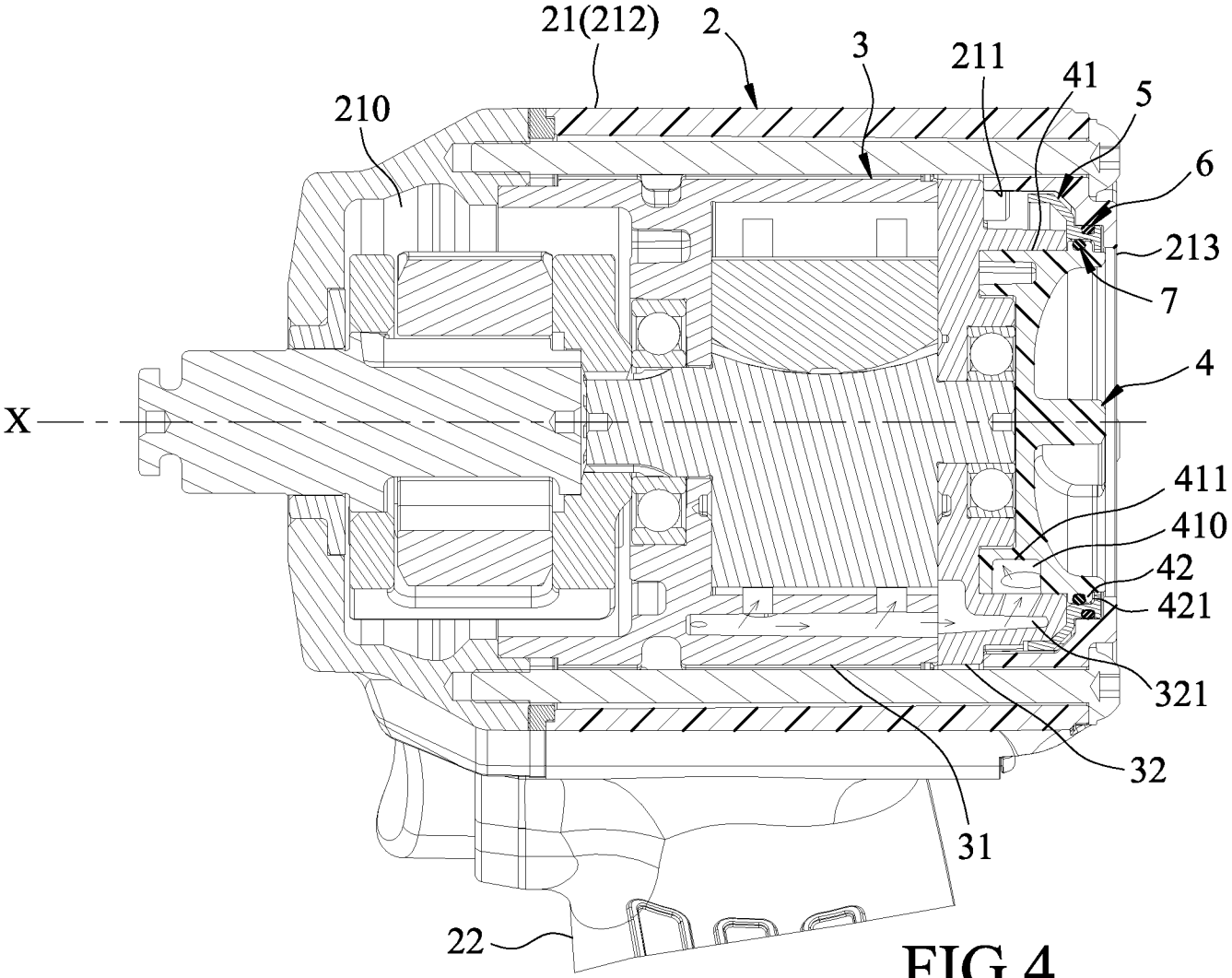
FIG. 4 is a fragmentary sectional view of the first embodiment.

Referring to FIGS. 2, 3 and 4, a pneumatic tool according to the disclosure includes a casing 2, a cylinder unit 3, a valve knob 4, and a pneumatic sealing device 500. The pneumatic sealing device 500 includes a ring member 5 and two ring seals 6, 7.

The casing 2 is made of a plastic material, and has a main portion 21 and a handle portion 22.

The main portion 21 has an inner surface 211 that defines a receiving space 210 therein, an outer surface 212 that is opposite to the inner surface 211, and an opening 213 that extends through the inner and outer surfaces 211, 212 along an axis (X) and that is in spatial communication with the receiving space 210. The cylinder unit 3, the valve knob 4 and the ring member 5 are arranged coaxially with respect to the axis (X).

The handle portion 22 is connected to the main portion 21 and is transverse to the main portion 21.

In the present embodiment, an angle between the main portion 21 and the handle portion 22 arranges from 60 degrees to 120 degrees such that the handle portion 22 and the main portion 21 cooperatively form a gun-shaped structure.

Figure 5:
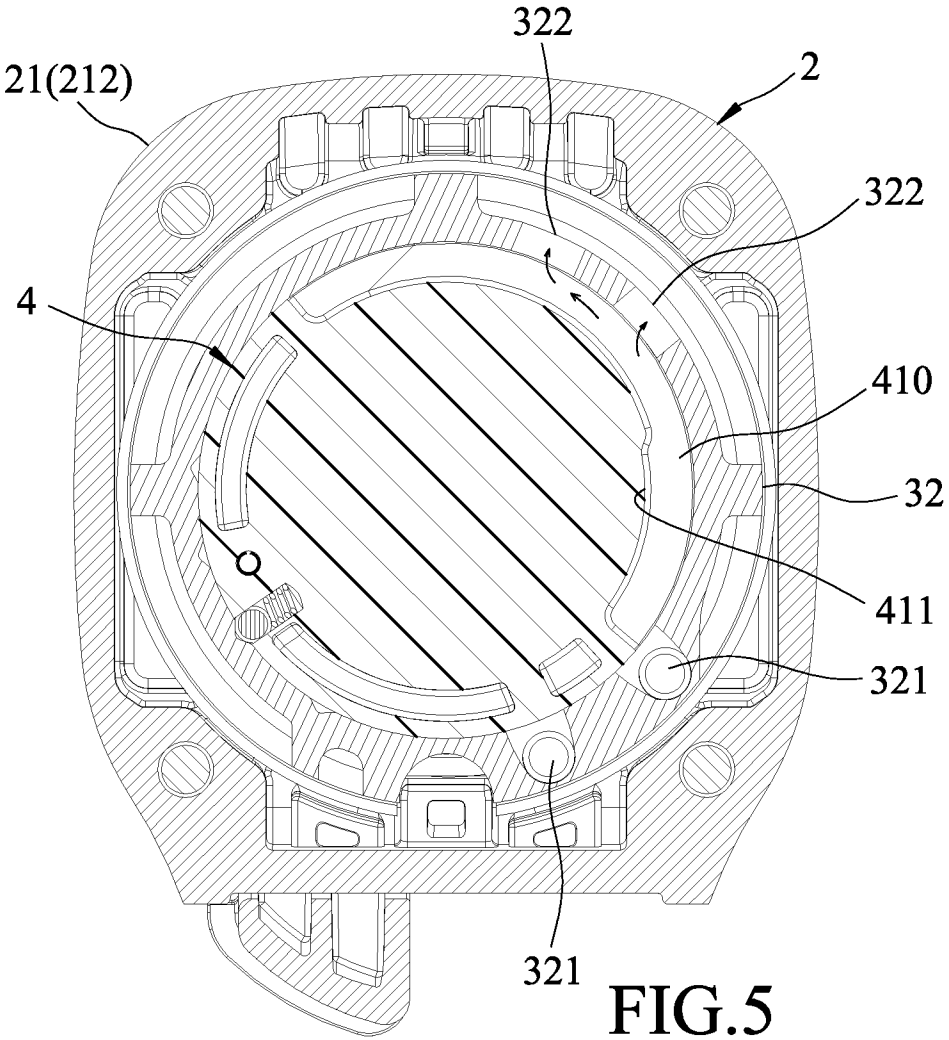
FIG. 5 is a sectional view of the first embodiment.

Referring to FIGS. 4 and 5, the cylinder unit 3 is mounted in the receiving space 210 of the casing 2, extends along the axis (X), and is adapted to be driven by air to generate power.

As shown in FIGS. 2, 4 and 5, the cylinder unit 3 includes a cylinder body 31 and a cylinder cap 32 that are connected together. The cylinder cap 32 is formed with two regulating holes 321 and two discharging holes 322. Details regarding functionality of the regulating and discharging holes 321, 322 are described in later paragraphs.

The valve knob 4 is disposed in the receiving space 210 of the casing 2 and between the opening 213 and the cylinder cap 32 of the cylinder unit 3, and includes an annular knob body 41 and a protruding ring portion 42. The knob body 41 is rotatably connected to the cylinder cap 32 of the cylinder unit 3, and is formed with a curved groove 411 that extends circumferentially and that cooperates with the cylinder cap 32 to define an air chamber 410. The protruding ring portion 42 protrudes outwardly from the knob body 41 and surrounds the axis (X).

Referring to FIG. 5, the valve knob 4 is adapted to be operable for regulating amount of the air circulating in the cylinder unit 3, that is, the valve knob 4 may be rotated so as to allow the air chamber 410 to be in spatial communication with at least one of the regulating and discharging holes 321, 322. More specifically, as high pressured air enters the cylinder unit 3, the valve knob 4 may be rotated to allow some of the air to flow into the air chamber 410 via the regulating holes 321, thereby reducing the amount of air entering the cylinder body 31 of the cylinder unit 3. On the other hand, the air that has entered the air chamber 410 is allowed to be discharged into the receiving space 210 of the casing 2 via the discharging holes 322 before it exits the pneumatic tool. Since details of the abovementioned air regulating and discharging process are well known in the art of pneumatic tools industry, they are not further described hereinafter.

Figure 6:
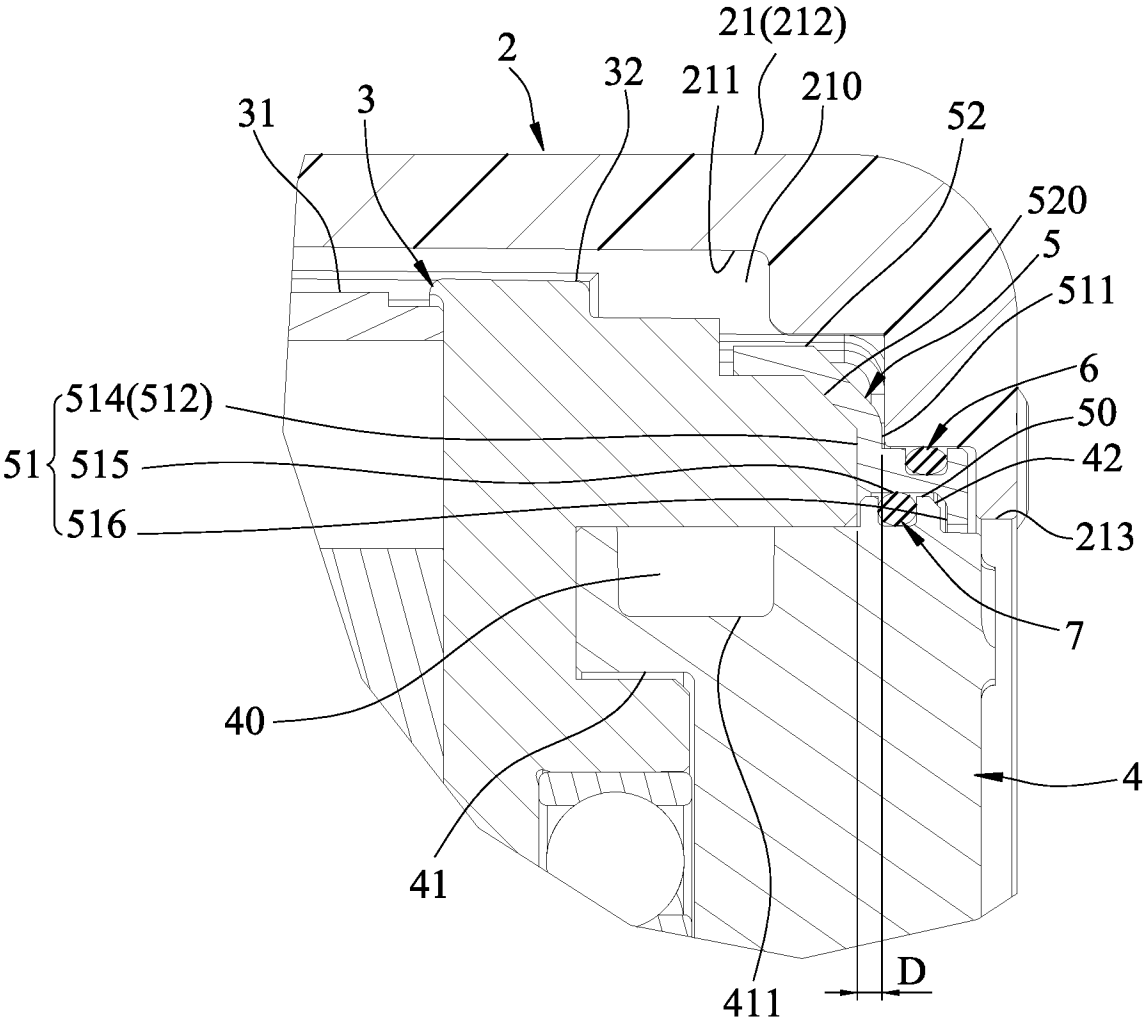
FIG. 6 is another fragmentary sectional view of the first embodiment.

Referring to FIGS. 2, 4 and 6, the ring member 5 of the pneumatic sealing device 500 is ring-shaped and rigid, is disposed in the receiving space 210, is connected to and surrounds the valve knob 4, and is clamped between the inner surface 211 of the casing 2 and the cylinder unit 3. In the present embodiment, the ring member 5 is made of iron, but the ring member 5 may be other rigid metal in other embodiments.

Referring to FIG. 6, the ring member 5 has a first portion 51 and a second portion 52. The first portion 51 surrounds the valve knob 4 and has an abutment segment 514, a first connecting segment 515 and a first end segment 516.

The abutment segment 514 has a first abutting surface 511 that abuts against the inner surface 211 of the casing 2, and a second abutting surface 512 that is spaced apart from the first abutting surface 511 along the axis (X), and that abuts against the cylinder cap 32 of the cylinder unit 3. The first connecting segment 515 extends transversely from the abutment segment 514 along the axis (X) toward the opening 213. The first end segment 516 extends transversely from the first connecting segment 515, cooperates with the abutment segment 514 and the first connecting segment 515 to form a stepped structure, and cooperates with the first connecting segment 515 and the cylinder cap 32 of the cylinder unit 3 to define a first ring space 50 that retains the protruding ring portion 42 of the valve knob 4.

The second portion 52 is connected to the first portion 51, surrounds the cylinder cap 32 of the cylinder unit 3, and is disposed between the inner surface 211 of the casing 2 and the cylinder cap 32. The first and second portions 51, 52 cooperatively define a second ring space 520 that receives an end portion of the cylinder cap 32.

It should be noted that since the first and second abutting surfaces 511, 512 of ring member 5 respectively abut against the inner surface 211 of the casing 2 and the cylinder cap 32 of the cylinder unit 3, a distance measured between the casing 2 and the cylinder unit 3 along the axis (X) is equal to a thickness (D) (see FIG. 6) of the first portion 51 of the ring member 5 between the first and second abutting surfaces 511, 512. Moreover, since the ring member 5 of the pneumatic sealing device 500 is rigid, that is, the thickness (D) of the first portion 51 is constant under normal circumstances, the distance between the casing 2 and the cylinder unit 3 is maintained to be constant as well.

For the two ring seals 6, 7 of the pneumatic sealing device 500, the ring seal 6 is disposed between the first portion 51 of the ring member 5 and the inner surface 211 of the casing 2 to form an airtight sealing between the ring member 5 and the casing 2, and the ring seal 7 is disposed between the first portion 51 of the ring member 5 and the valve knob 4 to form an airtight sealing between the ring member 5 and the valve knob 4.

In summary, by virtue of the pneumatic sealing device 500, the pneumatic tool according to the present disclosure has the following advantages.

In cases of plastic deformation of the casing 2, since the ring member 5 of the pneumatic sealing device 500 is rigid and is disposed between the casing 2 and the valve knob 4, the valve knob 4 will not be affected by the plastic deformation of the casing 2 and will remain in concentric alignment with the cylinder unit 3. In the same sense, the rigidity of the ring member 5 further ensures that the first ring space 50 remains unaffected by the plastic deformation of the casing 2, thereby ensuring a smooth rotation of the valve knob 4 within the first ring space 50.

It should be noted that, in variations of the present embodiment, the main portion 21 of the casing 2 may include a plurality of casing members that are fastened together by a plurality of fastening members. However, regardless of such configuration changes, the ring member 5 can still provide the same benefits as mentioned above due to the rigidity thereof.

Finally, since the ring member 5 remains stationary relative to the casing 2, the ring seal 6 disposed between the first portion 51 of the ring member 5 and the inner surface 211 of the casing 2 will not experience wear by rotation and, thus, may provide a better and longer-lasting sealing effect.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A pneumatic tool comprising:

a casing made of a plastic material, and having a main portion that has an inner surface defining a receiving space therein, an outer surface opposite to said inner surface, and an opening extending through said inner and outer surfaces and in spatial communication with said receiving space, and a handle portion that is connected to said main portion and that is transverse to said main portion;

a cylinder unit mounted in said receiving space of said casing and adapted to be driven by air to generate power;

a valve knob disposed in said receiving space of said casing and between said opening and said cylinder unit, rotatably connected to said cylinder unit, and adapted for regulating amount of the air circulating in said cylinder unit; and a pneumatic sealing device including a ring member that is ring-shaped and rigid, that is disposed in said receiving space, that surrounds and is connected to said valve knob, and that is clamped between said inner surface of said casing and said cylinder unit such that a distance between said casing and said cylinder unit is maintained to be constant.

2. The pneumatic tool as claimed in claim 1, wherein said opening of said main portion of said casing extends through said inner and outer surfaces along an axis, said cylinder unit, said valve knob and said ring member being arranged coaxially with respect to the axis, the distance between said casing and said cylinder unit being measured along the axis.

3. The pneumatic tool as claimed in claim 2, wherein said pneumatic sealing device further includes two ring seals, one of said ring seals being disposed between said ring member and said casing, the other one of said ring seals being disposed between said ring member and said valve knob.

4. The pneumatic tool as claimed in claim 3, wherein said ring member having a first portion that surrounds said valve knob and that has a first abutting surface abutting against said inner surface of said casing.

5. The pneumatic tool as claimed in claim 4, wherein the one of said ring seals is disposed between said first portion of said ring member and said inner surface of said casing to form an airtight sealing between said ring member and said casing, and the other one of said ring seals is disposed between said first portion of said ring member and said valve knob to form an airtight sealing between said ring member and said valve knob.

6. The pneumatic tool as claimed in claim 4, wherein:

said cylinder unit includes a cylinder body and a cylinder cap that is connected between said cylinder body and said valve knob;

said first portion of said ring member further has a second abutting surface spaced apart from said first abutting surface along the axis, and abutting against said cylinder cap of said cylinder unit; and a thickness of said first portion between said first and second abutting surfaces is equal to the distance between said casing and said cylinder unit.

7. The pneumatic tool as claimed in claim 6, wherein:

said first portion of said ring member further has an abutment segment that has said first and second abutting surfaces, a first connecting segment that extends transversely from said abutment segment along the axis toward said opening, and a first end segment that extends transversely from said abutment segment and that cooperates with said abutment segment and said first connecting segment to form a stepped structure;

said first connecting segment and said first end segment cooperate with said cylinder cap to define a first ring space thereamong; and said valve knob has a protruding ring portion that surrounds the axis and that is retained in said first ring space.

8. The pneumatic tool as claimed in claim 4, wherein:

said cylinder unit includes a cylinder body and a cylinder cap that is connected between said cylinder body and said valve knob; and said ring member further has a second portion that is connected to said first portion, that surrounds said cylinder cap, and that is disposed between said inner surface of said casing and said cylinder cap.

9. The pneumatic tool as claimed in claim 8, wherein said first and second portions of said ring member cooperatively define a second ring space that receives an end portion of said cylinder cap.

10. The pneumatic tool as claimed in claim 1, wherein said ring member is made of metal.

11. The pneumatic tool as claimed in claim 10, wherein said ring member is made of iron.

12. A pneumatic sealing device adapted for use in a pneumatic tool, the pneumatic tool including a casing that is made of a plastic material, a cylinder unit that is mounted in the casing, and a valve knob that is disposed in the casing, that is rotatably connected to the cylinder unit and that is adapted for regulating amount of air circulating in the cylinder unit, said pneumatic sealing device comprising a ring member including:

a first portion that is adapted for surrounding the valve knob, and that has a first abutting surface adapted for abutting against an inner surface of the casing, and a second abutting surface opposite to said first abutting surface and adapted for abutting against the cylinder unit such that a distance between the casing and the cylinder unit is maintained to be constant, and a second portion that surrounds the part of the cylinder unit and that is adapted to be disposed between the casing and the cylinder unit.

13. The pneumatic sealing device as claimed in claim 12, wherein:

said first portion of said ring member further has an abutment segment that has said first and second abutting surfaces, a first connecting segment that extends transversely from said abutment segment, and a first end segment that extends transversely from said abutment segment and that cooperates with said abutment segment and said first connecting segment to form a stepped structure; and said first connecting segment and said first end segment are adapted to cooperate with the cylinder unit to defined a first ring space for receiving a part of the valve knob.

14. The pneumatic sealing device as claimed in claim 12, wherein said first and second portions of said ring member cooperatively define a second ring space for receiving an end part of the cylinder unit.

15. The pneumatic sealing device as claimed in claim 12, further comprising two ring seals, one of said ring seals being adapted to be disposed between said first portion of said ring member and said inner surface of the casing to form an airtight sealing between said ring member and the casing, the other one of said ring seals being adapted to be disposed between said first portion of said ring member and the valve knob to form an airtight sealing between said ring member and the valve knob.

* * * * *